United States Patent [19]

Rose

[11] Patent Number: 4,917,422

[45] Date of Patent: Apr. 17, 1990

[54] PORTABLE LATCH DOOR LOCK

[76] Inventor: Hugh Rose, 5320 N. Camino Sumo, Tucson, Ariz. 85718

[21] Appl. No.: 124,606

[22] Filed: Nov. 24, 1987

[51] Int. Cl.[4] ..... E05C 19/18

[52] U.S. Cl. ..... 292/293; 292/264

[58] Field of Search ..... 292/293, 294, 288–292, 292/246, 248, 264

[56] References Cited

U.S. PATENT DOCUMENTS

| | | | |
|---|---|---|---|
| 848,644 | 4/1907 | Flegel | 292/288 |
| 913,223 | 2/1909 | Minderlein | 292/293 |
| 2,160,460 | 5/1939 | McManey | 292/293 |
| 2,161,673 | 6/1939 | Hammond | 292/294 |
| 2,288,022 | 6/1942 | O'Brien et al. | 292/291 |
| 3,313,566 | 4/1967 | Sipes | 292/292 |
| 3,640,558 | 2/1972 | Gewertz et al. | 292/292 X |
| 4,022,503 | 5/1977 | Bey | 292/288 X |
| 4,155,578 | 5/1979 | Rolland | 292/292 |
| 4,285,535 | 8/1981 | Leary | 292/293 |

FOREIGN PATENT DOCUMENTS

| | | | |
|---|---|---|---|
| 2617619 | 10/1977 | Fed. Rep. of Germany | 292/291 |

*Primary Examiner*—Gary L. Smith
*Assistant Examiner*—Eric K. Nicholson

[57] ABSTRACT

A portable latch door lock having a cable which extends around the door knob to balance the thrust of an opening door as shown and described. The latch includes a pin within the body which clamps the cable in a hole in the body when the mechanism is in its tightened locked position. The lock engages the door by engaging a recess and striker plate in the door frame and extends across the face of the door to prevent opening of the door. The lock is tightened to the door and the recess and striker plate by drawing proportion which engages the door in the direction of the striker plate.

10 Claims, 2 Drawing Sheets

PORTABLE LATCH DOOR LOCK

FIELD OF THE INVENTION

The present invention pertains to an apparatus and method for locking a swinging door and, more particularly, to methods and apparatus which may be utilized to efficiently secure the door closed in the frame without regard to effectiveness of the conventional door lock.

BACKGROUND OF THE INVENTION

Various types of safety latches, locks, door restraint mechanisms and fastening devices have been devised for preventing the opening of a door and the unauthorized intrusions of persons. Many such devices, such as dead bolt locks, can be picked, wrenched, or pried from the outside by intruders and thus do not offer the individual t he desired security.

It is known in the prior art to provide a means for engaging the latch bolt hole and the hole in the striker plate, and to secure the face of the door to the latch bolt hole independently of the normal door lock. U.S. Pat. No. 4,155,578 (Rolland) shows a portable latch which has a cable which engages the knob, and where a cable is secured to the jam insert mechanism by means of a V-notch. In the prior art, it is also known to compensate for torque on the safety latch by engaging the door knob as shown in U.S. Pat. Nos. 4,334,705 (Rumph), 2,532,586 (Wickwire), 827,624 (Foster) and 4,575,140 (Dargis).

U.S. Pat. No. 913.223 (Minderlein) discloses a door latch lock has a male thread and nut located on the portion which extends in and engages the bolt hole in the jam, and which provides for adjustments of the mechanism to tighten it against the door.

U.S. Pat. No. 4,155,578 (Rolland) shows a safety latch for inward swinging door which includes a fixable member to attach the door handle to the strap which engages the latch bolt hole in the door frame. The means for engaging the inward face (25) does not secure the flexible member when wrapped around the door knob.

SUMMARY OF THE INVENTION

This invention provides a portable latch door lock which is compact, and which provides means for forcing the means for engaging the recess toward the inward face of the door (forcing door closed). The means for forcing also clamps a cable which wraps around the door knob. In a single forcing or tightening step, both the door face and the cable are securely fixed in position. The cable around the door knob is provided to balance the thrust which is placed upon the portable latch door lock when the door is forced to open from the outside. This invention also provides for clamping the loose end of the door knob cable in the body of the portable latch door lock. In the body of the lock there is provided a pin and a spring where the pin is used to clamp the door knob cable, and the spring is used to disengage the pin from the cable when the latch is opened.

DETAILED DESCRIPTION OF THE PREFERRED EMBODIMENT

Figure 1:
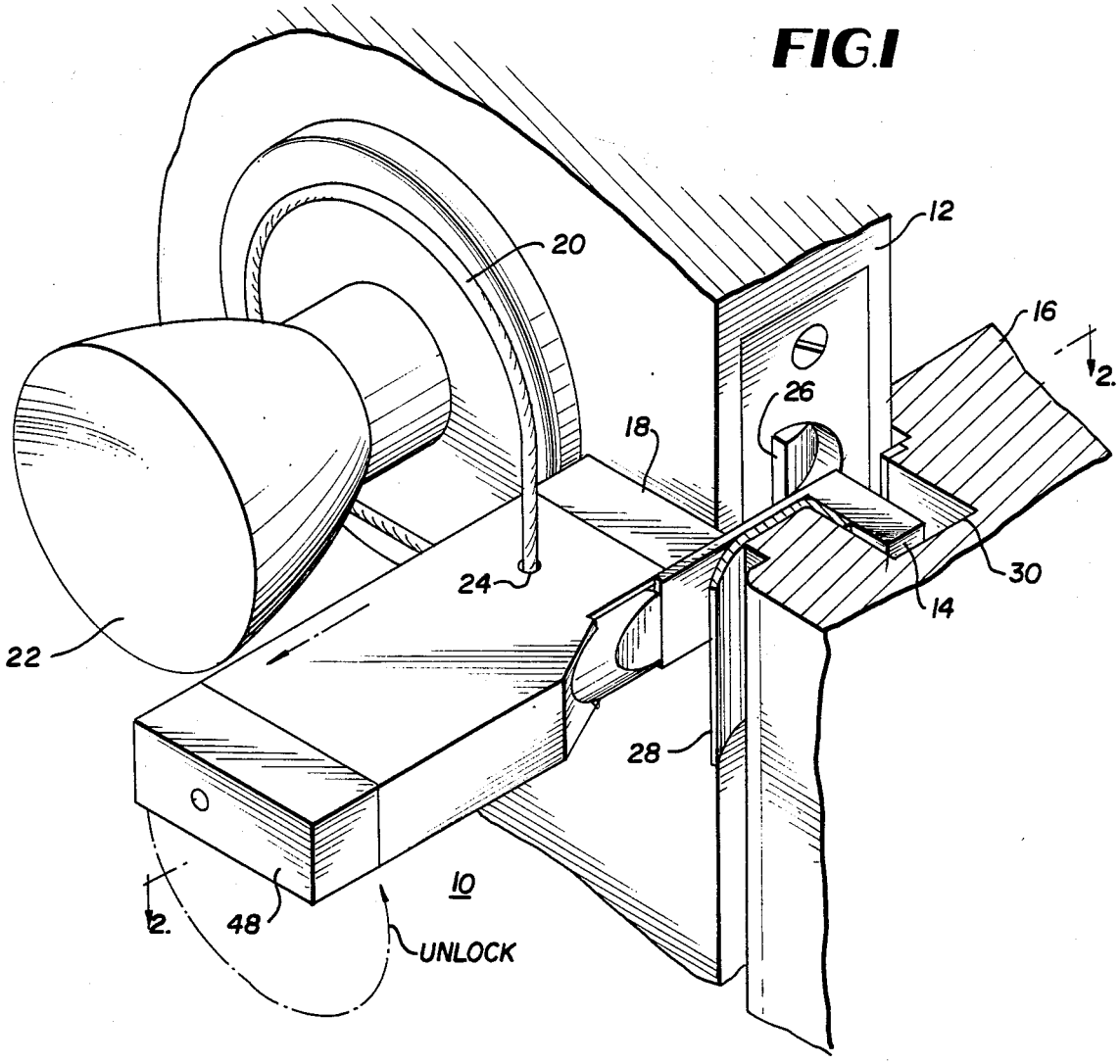
FIG. 1 shows an overall cut-away view of a typical door jam and bolt receiving hole with the portable latch door lock of this invention in place.

In FIG. 1 there is shown the assembled portable latch door lock 10 placed in position against a door 12 and with its means for engaging the striker plate 14 in place. When the latch door lock is tightened, the door 12 is forced against the jam 16 because of the tightening of the means for engaging the striker plate 14 with respect to the means for engaging the inward face of the door 18. A cable 20 is extended around the door knob 22 and inserted into a hole 24 in the body of the portable latch door lock 10. When the latch door lock of this invention is in place, the door bolt 26 is retained inside of the door 12 and is not relied upon for locking. Also during use of the latch door lock, the knob on the outside of the door no longer control the door bolt 26 and the knob in most locks has a loose feeling which would indicate to an intruder that the lock has been disabled. The means for engaging the striker plate 14 engages striker plate 28 and extends into the door jam bolt hole 30.

The door 12 of FIG. 1 is an inwardly opening door and the area to be secured is located on the same side of the door as is the portable latch door lock 10.

The door 12 when thrust open against the portable latch door lock 10 will bend the second rectilinear strip 56 away from the door and toward the jam. The body of the portable door latch 10 will rotate and the means for engaging the inward face 18 will rotate about t he corner of the door leaving a gap between the door face and the latch. When this occurs, the entire system may be bent, and the door will feel loose to an intruder. Therefore, it is necessary to take up the thrust of the inward forcing door. This is done by means of cable 20 which is clamped in hole 24. When cable 20 is tight, the rotation of the portable latch door lock 10 is substantially prevented because of the load taken by the door knob 22.

Figure 2:
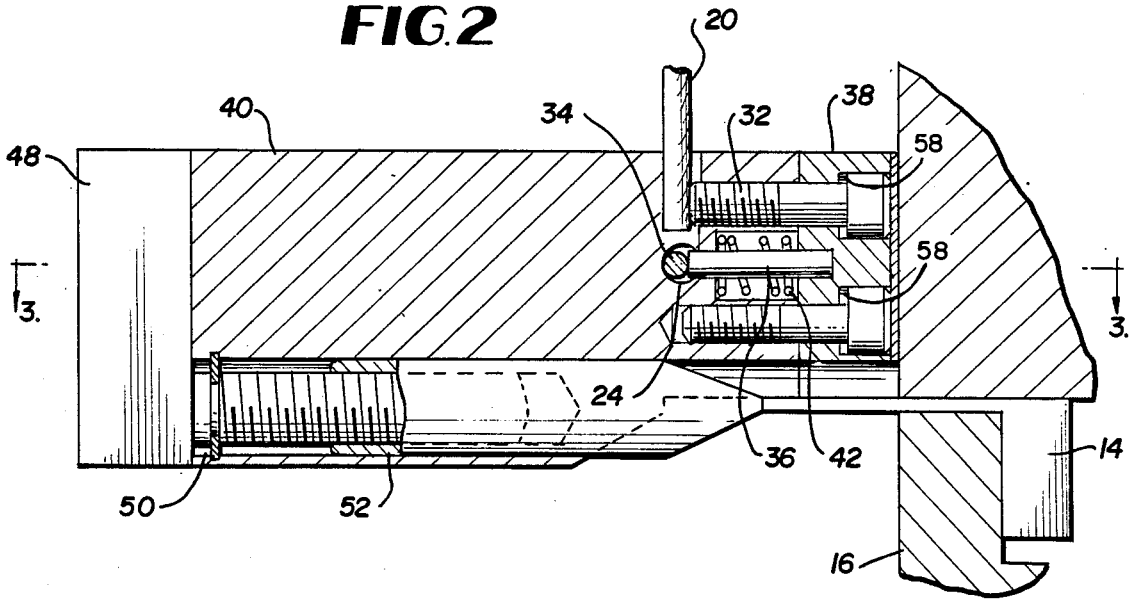
FIG. 2 shows a cut-away view of the latch door lock of FIG. 1 along Section Line 2—2.
Figure 3:
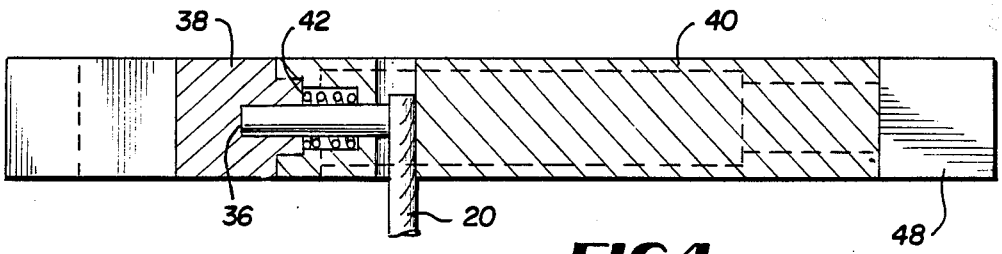
FIG. 3 shows a cut-away view of the latch door lock as seen from the top and as taken through the centerline of the cable clamping pin and cable hole (Section Line 3—3).
Figure 4:
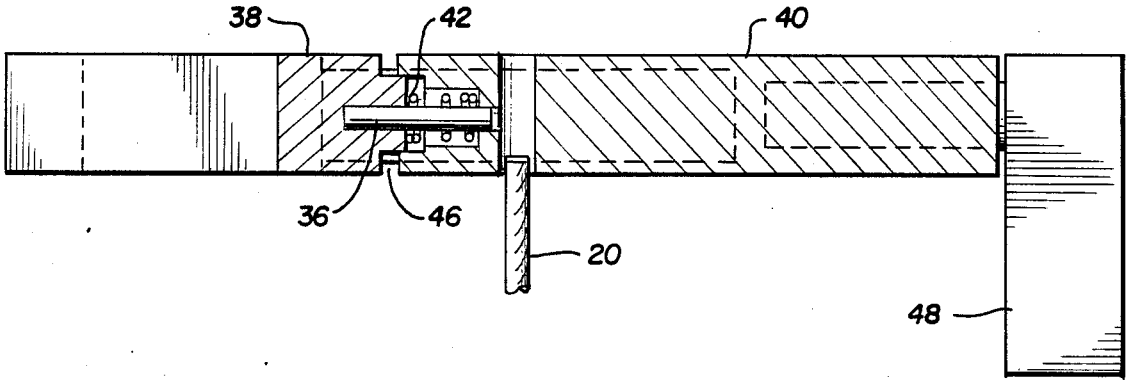
FIG. 4 shows the same cross-section as FIG. 3 except that the pin has been removed from contact with the cable by releasing the clamping mechanism.

FIG. 2 shows a sectional view of the latch door lock 10 taken along the centerline as depicted by section lines 2—2 of FIG. 1. The cable 20 is held securely in place in the body of the latch door lock 10 by means of a screw 32. The screw 32 is clamped down on the tip of cable 20 during assembly and is not disturbed or moved thereafter. The hole 24 which extends through the body is shown in FIG. 2 with the cable tip 34 extending through the hole. Also shown in pin 36 which is forced against cable tip 34 when a first block 38 is compressed against or forced to a second block 40. The first block 38 includes a means for engaging the inward face of the door 18, and the second block 40 is the main body of the assembly, and includes the hole 24 and the screw 32 for holding cable 20 in place. A spring 42 is placed between the first block 38 and the second block 40. The spring urges the blocks apart, and when the latch door lock is not in its locked position, the first block 38 will be forced away from the second block 40 and against the heads of bolts 32 and 44. This is best seen in FIG. 3 and FIG. 4 which are taken along the cross-sectional lines 3 of FIG. 2. When the spring forces the blocks 38 and 40 apart, a gap 46 occurs between the two blocks as shown in FIG. 4. This also releases the pressure on pin 36 allowing cable 20 to be released from the body of block 40 as shown in FIG. 4.

FIGS. 1 and 2 also show the rotatably adjustable third block 48. Attached to one end of the block 48 is a threaded rod 50 which extends into a female threaded tube 52 which is an extension of the means for engaging the striker plate 14. The rotary block 48 is turned to lock or unlock the portable latch door lock. In FIGS. 1 and 2, the latch is in its locked condition, and the threaded rod 50 pulls against female threaded tube 52 to pull the means for engaging the striker plate 14 against the door jam 16, and at the same time forces block 38 and its means for engaging the inward face of the door 18 against the door inner face.

Figure 5:
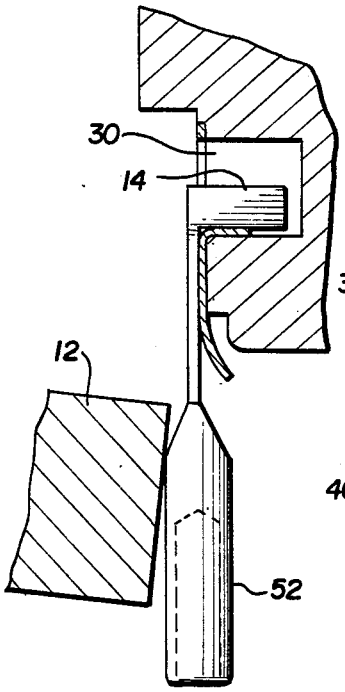
FIG. 5 shows the door latch lock disassembled and where the means for engaging the latch bolt hole is placed in position.

Initial assembly of the door latch to the door requires disassembly of the threaded rod 50 and the female threaded tube 52. After disassembly the means for engaging the striker plate 14 can be inserted into the door jam bolt hole 30 and the door rotated into place as shown in FIG. 5.

Figure 6:
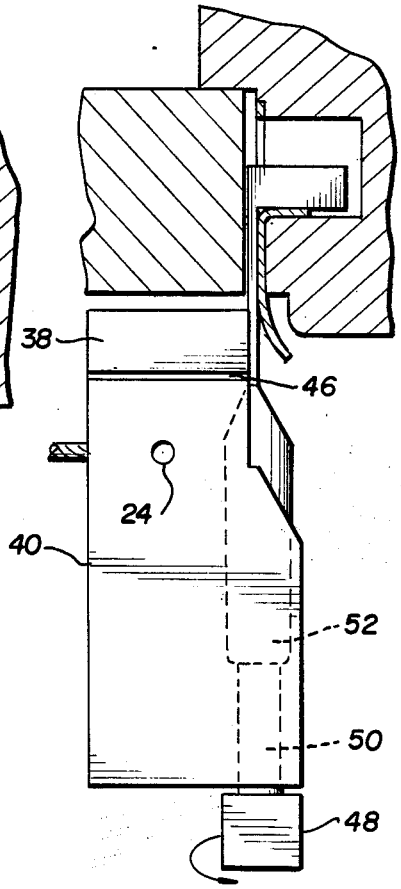
FIG. 6 shows the next step in assembly which is connecting of the threaded rod into a threaded sleeve of the means for engaging the latch bolt hole.
Figure 7:
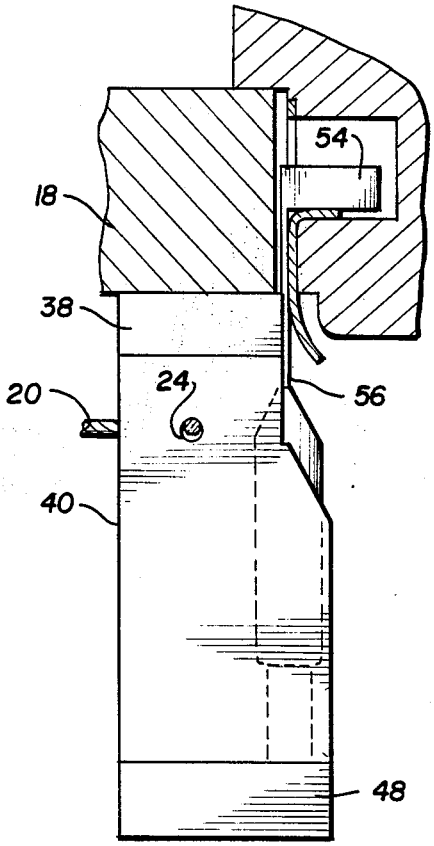
FIG. 7 shows the assembly of FIG. 6 wherein the means for forcing the inward face of the door against the latch bolt hole has been tightened, thus clamping the cable by means of the pin, and pressing the door against the jam.

When the door is in its closed position, the portable latch door lock is assembled by rotation of the rotary adjustable third block 48 and the threaded rod 50 to begin the looking operation generally as shown in FIG. 6. In this position, the gap 46 appears between the first block 38 and the second block 40. Also at this time the cable is inserted into the hole 24 in the block 40 and the cable is pulled tight against the door knob 22. When the cable is in place, the block 48 is rotated as shown in FIG. 6 until the assembly is completely tight as shown in FIG. 7. In the tightened position, the gap 46 disappears, the pin 36 is driven in to the cable 20, and the means for engaging the inward face of the door 18 is pressed firmly against the door 12.

The means for engaging the striker plate consist of a first rectilinear block 54 and a second rectilinear shape 56 which connects to the female threaded tube 52. When the portable latch door look is to be kept in luggage or otherwise stored, the means for engaging the striker plate 14 may be removed and the block 54 may be rotated 180° so that it lies over the means for engaging the inward face 18. This provides for a compact, easily carried assembly. Also, during carrying, the rotary adjustable block 48 is tightened to pull the first rectilinear block tight against the first block and compressing spring 42. This action of the spring holds the assembly under tension, thereby preventing loosening of the threaded rod with respect to the females threaded tube 52. The rotary adjustable third block 48 is aligned with the second block 40 during carrying.

Referring now to FIG. 2, there is shown a space 58 beneath the heads of screws 32 and 44. This space is equal to the gap 46 when the spring 42 is relaxed. This space also provides for the movement of the first block 38 with respect to the second block 40 and the movement of pin 36 against cable 20.

The means for forcing is the third block 48, screw 50, and the threaded tube 52. As rod 50 moves into tube 52 the entire mechanism is tightened and forced together. The third block 48 provides the handle which provides for the adjustment of the forcing means. The means for allowing limited movement between the second and third blocks is the space 58 beneath the heads of screws 32 and 44.

It will also be apparent from the foregoing that many other variations and modification ma be made in the method and apparatus described herein without substantially departing from the essential concept of the present invention. Accordingly, it should be clearly understood that forms of the invention described herein and depicted in the accompanying drawings ar exemplary only and are not intended as limitations in the scope of this invention.

What is claimed:

1. A portable latch door lock for a door which swings toward the area to be secured, said door having a frame, a striker plate having a latch bolt hole, a recess in said door frame comprising a bolt receiving hole which is surrounded by said striker plate latch bolt hole, a knob, and a latch bolt which is actuated by said knob and which moves from said door into said recess comprising in combination:

a means for engaging said recess in said door frame and said striker plate latch bolt hole;

a means for engaging the inward face of said door;

a means for forcing said means for engaging said recess toward said means for engaging the inward face of said door;

adjustable means for engaging said door knob comprising a cable which has a first end fixed to said means for engaging said inward face and which end fixed to said means for engaging said inward face and which has a second end which is adjustably fixed to said means for engaging said inward face;

a means for adjusting said means for forcing said means for engaging said recess toward said means for engaging said inward face of said door; and wherein said means for adjusting also tightens said adjustably fixed end of said cable means for engaging said door knob.

2. The portable latch door lock of claim 1, wherein said cable passes through a hole in said means for engaging said inward face.

3. The portable latch door lock in accordance with claim 2, wherein a cable clamping pin is located in said means for engaging said inward face, and which pin is driven into engagement with said cable when said means for adjusting said means for forcing said means for engaging said recess toward said means for engaging said inward face is tightened.

4. A portable latch door lock for a door which swings toward the area to be secured, said door having a frame, a striker plate having a latch bolt hole, a recess in said door frame comprising a bolt receiving hole which is surrounded by said striker plate latch bolt hole, a knob, and a latch bolt which is actuated by said knob and which moves from said door into said recess comprising in combination:

a means for engaging said recess and said striker plate latch bolt hole;

a means for engaging the inward face of said door;

a means for forcing said means for engaging said recess toward said means for engaging the inward face of said door;

adjustable means for engaging said door knob comprising a cable which has a first end fixed to said means for engaging said inward face and which has a second end which is adjustably fixed to said means for engaging said inward face;

a means for adjusting said means for forcing said means for engaging said recess toward said means for engaging said inward face of said door;

wherein said means for adjusting also tightens said adjustably fixed end of said cable means for engaging said door knob; and wherein said means for engaging the inward face of said door includes first and second blocks which are connected together by a means for allowing for movement of said blocks with respect to each other.

5. The portable latch door lock of claim 4, wherein said blocks are biased apart by a spring which is compressed between said blocks.

6. The portable latch door lock of claim 5, wherein a clamping pin is placed between said first and second blocks and extends into said hole in said means for engaging in one of said blocks.

7. The portable latch door lock of claim 1, wherein said means for engaging said recess and striker plate bolt hole comprises a first rectilinear block which enters said recess, which first rectilinear block is connected to a second thin rectilinear strip which passes between the door and the jamb.

8. The portable latch door lock of claim 4, wherein said adjusting means is a third block located on a face of said first or second block which is furthest from the face of said door and which is connected to said threaded rod of said adjusting means.

9. The portable latch door lock of claim 8, wherein said third block aligns with the means for engaging said inward face to form a continuous surface on four sides.

10. The portable latch door lock of claim 1, wherein said means for engaging said recess is removable from said means for engaging said inward face of said door so as to permit rotating of said means for engaging said recess so that it extends in the same direction as said means for engaging said inward face of said door to provide for a compact structure for transporting in luggage and the like.

* * * * *